United States Patent [19]

Knickerbocker

[11] Patent Number: 4,984,700

[45] Date of Patent: Jan. 15, 1991

[54] TAMPER INDICATING CLOSURE ASSEMBLY

[75] Inventor: Michael G. Knickerbocker, Upland, Calif.

[73] Assignee: Calmar, Inc., Watchung, N.J.

[21] Appl. No.: 437,592

[22] Filed: Nov. 17, 1989

[51] Int. Cl.[5] ..... B65D 51/18

[52] U.S. Cl. ..... 215/251; 215/250; 215/206; 215/204

[58] Field of Search ..... 215/250, 252, 253, 230, 215/277, 204, 216, 217, 251, 224, 225, 272; 220/258, 256, 265, 266

[56] References Cited

U.S. PATENT DOCUMENTS

| | | | |
|---|---|---|---|
| 3,812,989 | 5/1974 | Horvath . | |
| 3,838,785 | 10/1974 | Lancesseur | 215/251 |
| 4,440,306 | 4/1984 | Van Buskirk et al. . | |
| 4,475,661 | 10/1984 | Griffin . | |
| 4,480,760 | 11/1984 | Schonberger . | |
| 4,576,297 | 3/1986 | Larson . | |
| 4,579,240 | 4/1986 | Ou-Yang . | |
| 4,666,052 | 5/1987 | Ou-Yang | 215/230 |
| 4,747,499 | 5/1988 | Gach et al. . | |
| 4,747,500 | 5/1988 | Gach et al. | 215/250 |
| 4,793,122 | 12/1988 | Towns et al. . | |

*Primary Examiner*—George E. Lowrance
*Assistant Examiner*—Stephen Cronin
*Attorney, Agent, or Firm*—Watson, Cole, Grindle & Watson

[57] ABSTRACT

A tamper indicating closure assembly for a removable closure cap includes a removable overcap which completely surrounds the closure cap, the overcap having a transparent window, and a rupturable membrane intermediate the closure cap and the overcap being exposed through the window. One portion of the membrane is secured to the closure cap and another portion thereof is secured to the overcap so that relative movement between the overcap and the closure cap causes an unsecured portion of the membrane to tear.

5 Claims, 1 Drawing Sheet

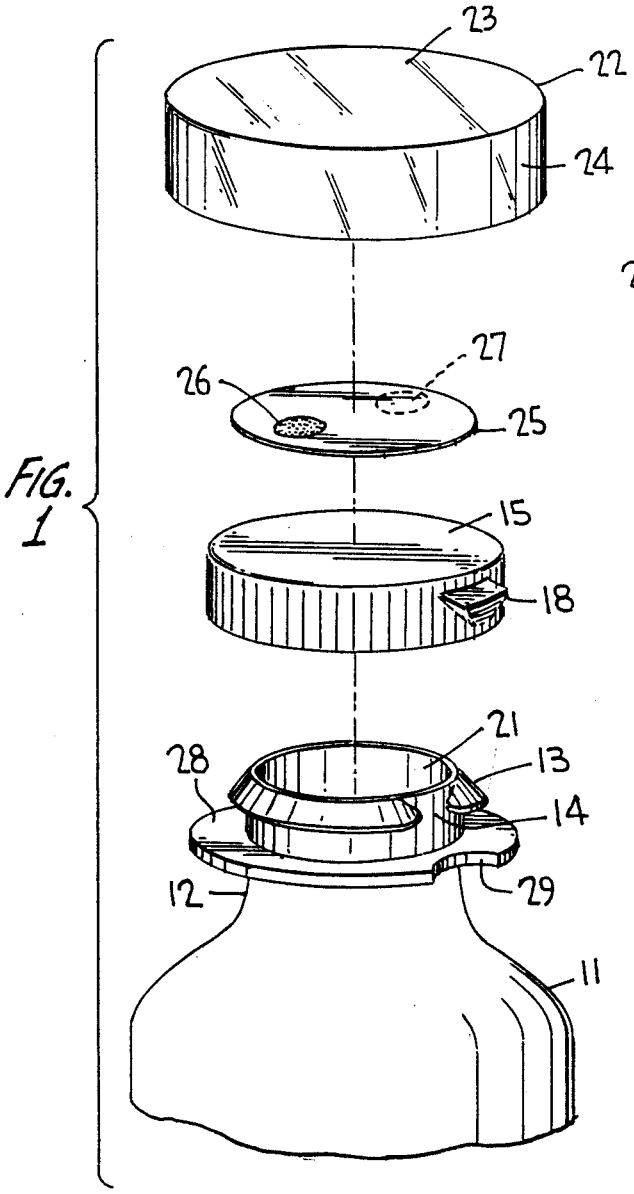
FIG. 1
FIG. 2
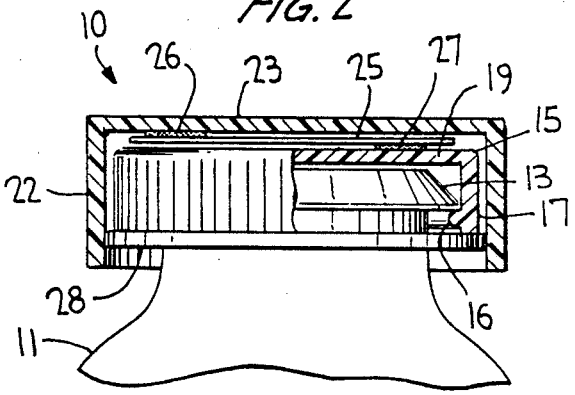
FIG. 3
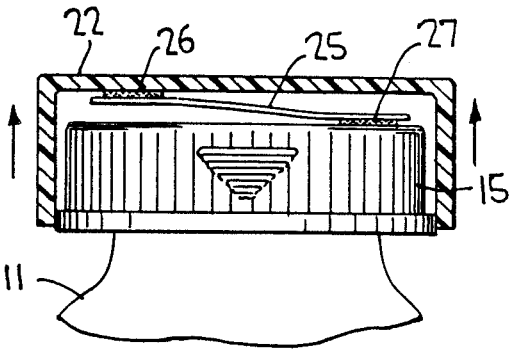
FIG. 4
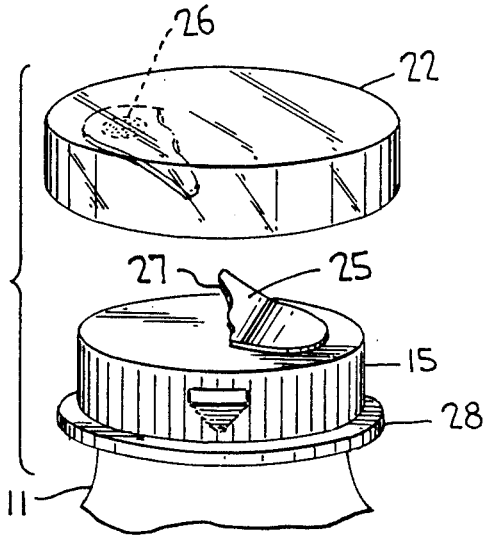

TAMPER INDICATING CLOSURE ASSEMBLY

BACKGROUND OF THE INVENTION

This invention relates to an assembly for a closure cap or lid of a container which provides an indication to the user that the closure cap has been tampered with or previously removed.

Various approaches have been taken in the past to provide evidence of tampering with the contents of containers and vials of especially pharmaceuticals and various comestibles.

A foil seal or the like is oftentimes bonded or welded along the rim of the container neck requiring a rupturing of the seal to facilitate access. A closure cap is then snap-fitted or threaded onto the container neck which, upon removal, requires the user to rupture the seal to gain access to the contents. If the seal is already ruptured after cap removal, the user immediately detects tampering.

This approach is useful, although not entirely foolproof, as the user should be aware of tampering before purchase and at the time the bottle is removed from the shelf.

Several tamper evident caps have been devised for use with a sealed liner. For example, the liner is exposed through a transparent window in the closure cap, and is adhesively secured to the underside of the cap so that, upon cap removal, the seal is ruptured giving evidence through the window of tampering before first use. Otherwise, a tine depending from the cap extends through the liner, or bears against the liner, so that upon cap removal the liner is ruptured giving evidence of tampering.

Another approach is to provide discs secured to the underside of the cap and to the rim of the bottle with microencapsulated dyes between the discs so that, upon cap removal, the micro-capsules are ruptured giving evidence of tampering.

Still another approach provides for an overcap on the closure cap, the closure cap having warning indicia visable through windows in the overcap upon overcap rotation in one direction.

Although each of these prior art approaches provides tamper-evidence, they are incapable of being mass produced effectively and economically, and some are rather awkward to operate, while others are not reliable in providing the necessary telltale tampering for which they are designed. And, most tamper evident closures require the closure cap itself to be rotated or moved before tampering is detected.

SUMMARY OF THE INVENTION

It is therefore an object of the present invention to provide a tamper indicating closure assembly which can be easily and economically mass produced yet is highly reliable and effective in providing evidence of tampering before removal or movement of the closure cap.

Pursuant to this objective, the present invention provides for an overcap, having a transparent window, completely surrounding a closure cap removably engaged with the container neck. A rupturable sheet or the like is disposed between the closure cap and the overcap and is exposed through the window. The sheet is adhesively secured or otherwise bonded at one portion to the overcap and at another portion to the closure cap. Thus, upon overcap movement or removal, the intermediate sheet tears giving evidence of tampering through the window.

The intermediate sheet can be secured in place to the overcap and the closure cap by spaced spots of adhesive, by spaced welding spots, or the like.

The overcap has a circular end wall and a depending cylindrical skirt for telescoping over the closure cap likewise having a circular end wall and a cylindrical skirt. The intermediate sheet may be secured in place to the circular end walls of the overcap and the closure cap.

The overcap skirt is of sufficient depth to extend beyond the edge of the closure cap skirt when in place on the container. And, the overcap is frictionally held in place and centered on the container by the provision of an annular, transversely extending flange on the container neck.

Other objects, advantages and novel features of the invention will become more apparent from the following detailed description of the invention when taken in conjunction with the accompanying drawings.

BRIEF DESCRIPTION OF THE DRAWINGS

FIG. 1 is an expanded perspective view of the tamper indicating closure assembly according to the invention shown together with a bottle or vial with which it is intended to be used;

FIG. 2 is a view, partly in cross-section, of the assembly of FIG. 1 at a slightly enlarged scale;

FIG. 3 is a view similar to FIG. 2 showing the overcap in the process of removal; and FIG. 4, is a perspective view of the present assembly shown after overcap removal.

DETAILED DESCRIPTION OF THE INVENTION

Turning now to the drawings wherein like reference characters refer to like and corresponding parts throughout the several views, the assembly, generally designated 10, is intended for use with a container such as 11 of plastic or glass material. The container neck 12 has a discontinuous annular locking rib 13 forming a small gap 14.

A closure cap 15 is designed for snap-fitting engagement with rib 13 and removal from the container as, for example, disclosed in U.S. Pat. No. 3,812,989. The snap closure forms no part of the invention, and a closure cap having internal threads cooperating with external threads on the container neck could be likewise used without departing from the invention.

The snap closure cap has a continuous or discontinuous inwardly projecting annular rib 16 which engages beneath rib 13 when in place as shown in FIG. 2. A locking lug (not shown) projects radially inwardly from one side of skirt 17 of the closure cap for likewise engaging beneath rib 13. And, the closure cap has a thumb tab 18 which, when oriented with gap 14 upon rotation of the cap relative to the container, permits the user to disengage the cap from the container upon applying an upward finger force against tab 18, as conventionally known.

The closure cap has a circular end wall 19 which overlies and closes container opening 21 of the container.

An overcap 22, which may be of transparent plastic material, has a circular end wall 23 and a depending skirt 24. Otherwise, only end wall 23, or some designated portion or portions thereof, may be transparent for purposes which will be hereinafter explained.

In an assembled condition, the overcap telescopes over and completely surrounds the closure cap.

An intermediate sheet 25, of paper, foil, a combination of paper and foil, or the like, is disposed between the closure cap and the overcap, and may lie between the circular end walls thereof. The sheet, or membrane, is exposed through the transparent window of the overcap which, as shown, comprises the end wall 23 thereof. Otherwise, sheet 25 may be disposed between skirts 17 and 24, and be exposed through transparent skirt 24 or a transparent section of skirt 24.

One portion of the sheet 25 is secured, as by dot 26 of adhesive, to the underside of end wall 23 of the overcap, and another portion of the sheet is secured as by a dot of adhesive 27 to the upper surface of end wall 19 of the closure cap. Otherwise, sheet 25 may be secured in place as by welding, or some other type of securement, and dots 26, 27 may form different shapes, sizes and relative spacing than shown, without departing from the invention.

Upon removal of the overcap, as by lifting off in the direction of the arrows of FIG. 3, and shown fully removed in FIG. 4, sheet 25 is ruptured or torn as at 27 along a portion between the secured portions of the sheet. This tear line, or lines, 27 is visable through the transparent overcap, or its selected transparent window portion if provided, thereby indicating tampering as the overcap must be first removed to gain access to the closure cap for removal.

The closure cap is maintained completely inaccessible, except upon overcap removal as aforedescribed, by the provision of what has become known in the art as a "tooth ring" 28 which laterally extends from the container neck. This tooth ring typically prevents prying open of the closure cap by a child having the tendency to bite the closure cap with his/her teeth. The tooth ring is, however, provided with a cutout 29 to provide unobstructed access to thumb tab 18.

Moreover, skirt 24 of the overcap extends below the end of the closure cap skirt 17 and below tooth ring 28, in the assembled condition of FIG. 2. The overcap skirt is sized as to lightly or frictionally engage ring 28 and to cover the laterally extending thumb tab 18. Also, ring 28 functions to center the overcap on the container in coaxial relationship.

Sheet 25 is shown as a circular disc although it may take other shapes, such as a strip, without departing from the invention. The outer surface of the sheet may be dyed and its internal fibers undyed so as to present a distinct contrast in colors along tear line 27 upon overcap removal. The adhesive dots, or the like, may lie on opposite sides of the cap center line, on the same side, or superimposed, and may be of different sizes, spacing, shapes and materials, without departing from the invention.

And, the closure cap may be threaded to the container, or may otherwise engage the container within the purview of the invention.

Obviously, many other modifications and variations of the present invention are made possible in the light of the above teachings. It is therefore to be understood that within the scope of the appended claims, the invention may be practiced otherwise than as specifically described.

What is claimed is:

1. In a linerless tamper indication closure assembly comprising, in combination, a closure cap for a container comprising a uniplanar circular end wall for disposition entirely above the neck of a container and a depending cylindrical skirt for telescoping reception of the container neck, cooperating non-bondable means on the skirt and the container neck for removable engagement of the cap with the container, a removable overcap having a uniplanar circular end wall overlying said closure cap end wall, and said overcap having a depending circular skirt surrounding said cap skirt coupled to the container neck and without being coupled to said closure cap, said overcap having a transparent window, a rupturable sheet disposed between said closure cap and said overcap and being exposed through said window, first means bonding said sheet to said closure cap and second means bonding said sheet to said overcap, whereby said sheet is caused to rupture upon lifting off said overcap from said closure cap, as well as upon turning said overcap in either direction relative to said closure cap, thereby evidencing tampering before removal of said closure cap from said container neck.

2. In the closure assembly according to claim 1, wherein said overcap skirt extends beyond a lower edge of said closure cap skirt.

3. In the closure assembly according to claim 1, wherein at least said overcap end wall is transparent so as to define said window, said sheet lying between said end walls.

4. In the closure assembly according to claim 1, wherein said first and second bonding means comprise spaced dots of adhesive.

5. In the closure assembly according to claim 1, wherein said neck has an annular flange located below said cooperating means on said neck, said overcap skirt surrounding said flange.

* * * * *